United States Patent [19]

Simonetti

[11] Patent Number: 4,728,109

[45] Date of Patent: Mar. 1, 1988

[54] BALLISTIC PROJECTILE-ARRESTER, HAVING A REGENERATION AND/OR RECOVERY SYSTEM FOR THE IMPACT MATERIAL

[75] Inventor: Andrea Simonetti, Rome, Italy

[73] Assignee: Impresa Costruzioni Soc. FRA. SA. S.r.l., Rome, Italy

[21] Appl. No.: 845,275

[22] PCT Filed: May 31, 1985

[86] PCT No.: PCT/IT85/00004

§ 371 Date: Jan. 29, 1986

§ 102(e) Date: Jan. 29, 1986

[87] PCT Pub. No.: WO85/05672

PCT Pub. Date: Dec. 19, 1985

[30] Foreign Application Priority Data

Jun. 1, 1984 [IT] Italy ..... 48308 A/84
Jan. 4, 1985 [IT] Italy ..... 47522 A/85

[51] Int. Cl.[4] ..... F41J 1/12

[52] U.S. Cl. ..... 273/410; 209/139.1; 209/147; 209/906; 209/925

[58] Field of Search ..... 273/410, 404; 73/167; 209/134, 135, 906, 136, 911, 137, 920, 138, 925, 138 R, 146, 147

[56] References Cited

U.S. PATENT DOCUMENTS

| | | | |
|---|---|---|---|
| 1,728,046 | 9/1929 | Duerr | 209/134 X |
| 2,411,026 | 11/1946 | Conner et al. | 73/167 |
| 2,850,162 | 9/1958 | Widmer | 209/134 |
| 3,572,503 | 3/1971 | Hezel | 209/920 X |
| 3,920,542 | 11/1975 | Laird et al. | 209/134 |
| 4,431,530 | 2/1984 | Syben | 209/138 |

*Primary Examiner*—Paul E. Shapiro
*Attorney, Agent, or Firm*—Beveridge, DeGrandi & Weilacher

[57] ABSTRACT

A ballistic projectile arrester having a regeneration and/or recovery system for the impact material, and which is particularly suitable for the recovery of projectiles fired by small arms or the like in indoor firing ranges or shooting galleries is disclosed. The projectiles are fired into a quantity of granular material which is preferably fireproof and capable of dissipating the kinetic energy of projectiles in a safe way. The granular material is supported so as to provide a sloping surface having a maximum thickness at the point of penetration of the projectiles into the granular materials. The mixture of materials and projectiles is kept circulating in such a manner that the projectiles absorbed by the granular materials can be removed and the granular materials can be continuously recycled back into the separator to replenish the materials which have been removed from the impact area.

34 Claims, 15 Drawing Figures

BALLISTIC PROJECTILE-ARRESTER, HAVING A REGENERATION AND/OR RECOVERY SYSTEM FOR THE IMPACT MATERIAL

The present invention relates to a ballistic projectile-arrester having a regeneration and/or recovery system for the impact material, said projectile-arrester being suitable for firing with small arms or with arms of other kinds, in particular in indoors firing grounds or shooting-galleries. More particularly, the present invention relates to a ballistic projectile-arrester for small arms that are capable of shooting high kinetic energy projectiles, said projectile-arrester comprising, as a slowing down structure, a granular material system whch is preferably fireproof and allows a soft impact with the projectile and the dissipation of said kinetic energy in a fully safe way, as well as a system that allows the granular material to be recovered and the fired projectiles to be eliminated.

As it is well known, a large number of the most various structures have been adopted up to the present time as ballistic projectile-arresters, which structures are effected by serious practical drawbacks and pollution problems.

For instance, the less sophisticated structures realized up to now, consisting in projectile-arresters made up of walls or stacks of wood, or of piles of pneumatic tires, heaps of sand, embankments, and so on, show the drawbacks of the requirements of a costly and careful maintenance, and of a poor reliability from the safety viewpoint.

Some types of projectile-arresters already known at the present time, consist essentially of a metal impact surfaces which convey, with no possibility of return of the projectiles thanks to their suitable geometric shapes, the projectiles and the respective fragments towards a deceleration or kinetic energy dissipation chamber, where they are finally collected. With such a kind of arrangement, the projectile impact onto the metal causes a large production of fragments, dusts and lead vapors.

It is well evident that the most serious or dangerous drawback of the projectile-arresters of the metal type that remains unsolved is the drawback of the formation of dusts and of lead vapors generated during the strong impact, which is partially inelastic, between the high kinetic energy projectile and the sloping metallic plate onto which the projectile shatters.

Moreover, though the projectile-arresters of the metallic type do not present the unsolvable problem of the rebound, they present, at least at a certain distance, some features of lack of safety for the personnel.

A further serious drawback is the problem of disposal of said lead vapors, as their direct dispersal into the environments would surely give incalculable damages. On the other hand, the disposal of said noxious vapors through a filtering or an analogous system cannot be proposed because of the very high investment and plant costs, as for instance the need for skilled personnel in the use of the necessary specialized equipment.

A further type of projectile-arrester employed at the present time is that of the non metallic type (i.e., that employing wooden crosspieces, pneumatic tires, sand, etc.), which types present a series of drawbacks that caused the same to be abandoned. Indeed, such projectile-arresters are poorly reliable for the personnel and in addition they become easily saturated with lead and fragments or debris; moreover, they are inconvenient in their maintenance because of the frequent and costly interventions as well as of the periodic substitution of the whole impact structure, be such structure made up of crosspieces, pneumatic tires, rubber slabs etc., or of any other material in traditional use.

More particularly, sand embankments give rise, in addition to lead saturation, also to a persisting dust cloud consisting of siliceous dusts that obscure the end part of the shooting-gallery.

Earth banks are suitable for outdoor firing grounds only, which because of various reasons, are progressively giving way to the indoor grounds.

It is therefore well evident that there is a need for a ballistic projectile-arrester according to the present invention which can obviate, as a result of its structural and functional characteristics, the drawback of dusts and lead vapors formation as well as the drawback of their disposal, as no equipment is to be provided for filtering the smokes or the dust clouds. Moreover, the maintenance problems are simultaneously avoided by means of the employment of the self-regenerating impact system with the projectiles fired.

A further object of the present invention is that of supplying a regeneration system which is advantageously realized with a closed air cycle so that the need is avoided of restoring air and of providing interchanges and contacts with the air of the firing ground itself.

It is therefore a specific object of the present invention a ballistic projectile-arrester suitable for fires with small arms as well as with other types of arms, particularly in the case of indoors firing grounds or shooting-galleries, said projectile-arrester being characterized in that it comprises a projectile impact structure consisting of granular material in the form of a heap and a regeneration and/or recovery very system of said granular material.

According to a preferred embodiment of the present invention, said granular material is fireproof.

The granular material which is the impact structure of the projectile-arrester according to the present invention can be indifferently formed by powders, granules, waste or chips of foamed and unfoamed plastic materials, foam rubber,foodstuff grains, cork, woodshavings of the "Populit" type, chips or powder material from pneumatic tires, cork wastes, feathers, wood-shavings, wood powders, hay, other dried grasses, expanded minerals, artificial powders or granular materials, and so on.

According to a particularly preferred embodiment of the projectilearrester of the present invention, said regenerating and/or recovering system of the impact structure material is made up of a supporting and conveyor means for the granular material mixed with the projectiles to convey the same towards a separation and collecting means of said projectiles, the system also comprising mechanical means for conveying said granular material again towards the distribution means that spreads the same onto the material heap itself.

According to an embodiment of the projectile-arrester of the present invention, said supporting and conveyor means of the granular material are made up of gate means or conveyor belt means.

Further according to the present invention, said supporting and conveyor means are arranged at a slope to the horizontal plane and they move in the direction which the projectiles are coming from or, according to another kind of embodiment, in the direction opposite to that from which the projectiles are coming.

Further according to the present invention, said supporting and conveyor means of the granular material are arranged at a slope which is quite the same as the angle of slide of the mass of said material, and they can move downward so as to give rise to a motion of said mass with no internal sliding towards said separation means.

According to another embodiment of the projectile-arrester according to the present invention, said supporting and conveyor means are two in number and they are arranged according to the angle of slide of the heap so as to cause said heap to move in the transverse direction with respect to the axis of the firing ground.

Advantageously, further conveyor means are provided below said supporting and conveyor means, for conveying the granular material towards said separation means.

Further according to the present invention, such additional conveyor means consist of a metallic conveyor belt, or a synthetic or mixed type conveyor belt, or of another mechanical means.

In another embodiment of the projectile-arrester according to the present invention, means are provided on said supporting and conveyor means of said granular material, for the regulation of the conveyance speed, for the interception and for the metering of said material downstream said supporting and conveyor means.

Advantageously, said separation means comprise delivery means provided within conduit means, whose delivered fluid, which is preferably air, acts on said granular material mixed with said projectiles and carried direct by said supporting and conveyor means or by said further conveyor means, so that the granular material is pushed by caused to pass through said conveyor conduit means and to reach said heap, while the projectiles drop by gravity into the collection means.

According to the present invention, the fluid acting as separating agent of the granular material from the projectiles, is introduced again into said delivery means through further conduit means connecting said delivery means with the top of said material heap.

In particular, said delivery means can be made up of an ejector or a blower, and automation and self-regulating means can also be provided for the recirculation process on said separation and successive conveyor means.

It should be noted that filtering means can also be provided upstream said conduit means connecting the delivery means with the top of the heap.

In a further particularly preferred embodiment according to the present invention, said granular material regeneration system comprises vibrating means as well as conveyor means which cause the motion and the conveyance of said material, and it also comprises means for recovering the material, mechanical delivery means that convey said granular material together with the fired projectiles towards separating means in which said projectiles are collected, and feeding conduit means for conveying the granular material again into the feeding chamber.

Said granular material regeneration system can also be associated to other similar units, according to the particular structural needs of the firing ground in which the ballistic projectile-arrester is provided according to this invention, said units being in a suitable number as regards the length of the granular material heap in the transverse direction.

Further according to the present invention, air pre-filtering means are provided downstream said conduit means for re-conveyance, such pre-filtering means intercepting the granules still suspended in the air flow through the same, and first conduit means are also provided that convey the air from the filter means and the fines of the dusts towards filtering means that cause said dusts to settle, second conduit means starting from said filtering means and conveying said air under the heap of the granular material.

More particularly, according to the present invention, said vibrating and conveyor means are formed by sloping walls located under the heap of the material, some electrovibrating means suitably spaced apart from one another being provided on said walls.

In another embodiment of the present invention, said vibrating and conveyor means are made up of ballistic steel plates arranged almost at right angles with respect to the sloping line of the exposed surface of the heap of the material, inside said heap, as well as of vibrating means.

Further according to the present invention, said vibrating and conveyor means consist of a conveyor belt arranged under said material heap and almost parallel to the sloping line of the exposed surface of the heap of the granular material, whose motion causes the material itself both to move and to be conveyed.

In another embodiment of the present invention, said vibrating and conveyor means are made up of a steel plate provided below the heap of the granular material, at a slope about the same as that of the exposed edge of said heap, some vibrating means being provided under said plate which cause the material to move towards a passage provided below the same.

Advantageously, a melting crucible is provided downstream the collection means of the recovered projectiles, for melting lead, in which crucible said projectiles are automatically conveyed, and some ingot molds are also provided in which molten lead is solidified in the form of ingots. Said system makes the recovery and reutilization of lead easier, with all consequent well known practical advantages that can be realized in such way.

The present invention will be disclosed in the following according to some specific embodiments of the same with particular reference to the enclosed drawings, wherein.

Figure 1:
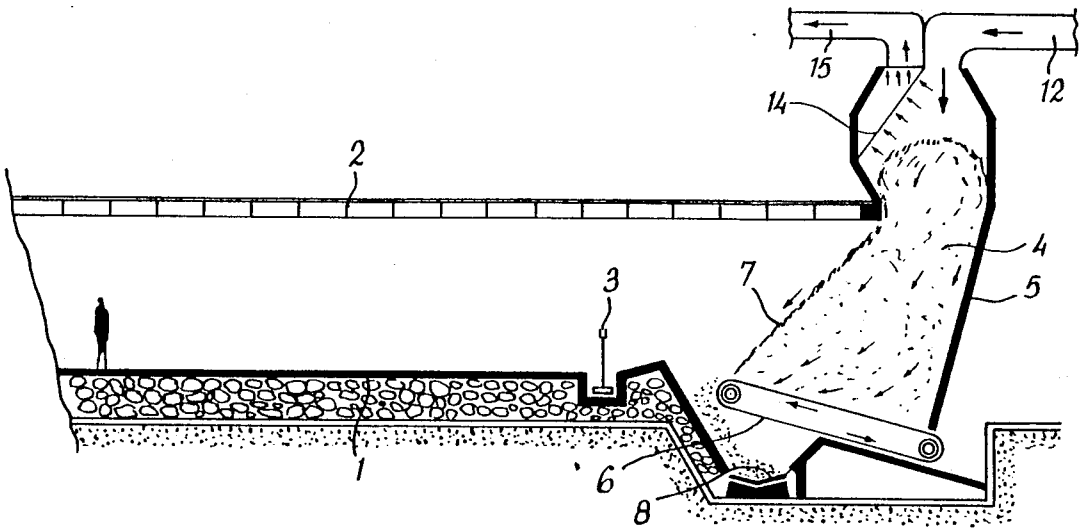
FIG. 1 shows a longitudinal vertical cross-section of a first embodiment of the projectile-arrester according to the invention.
Figure 3:
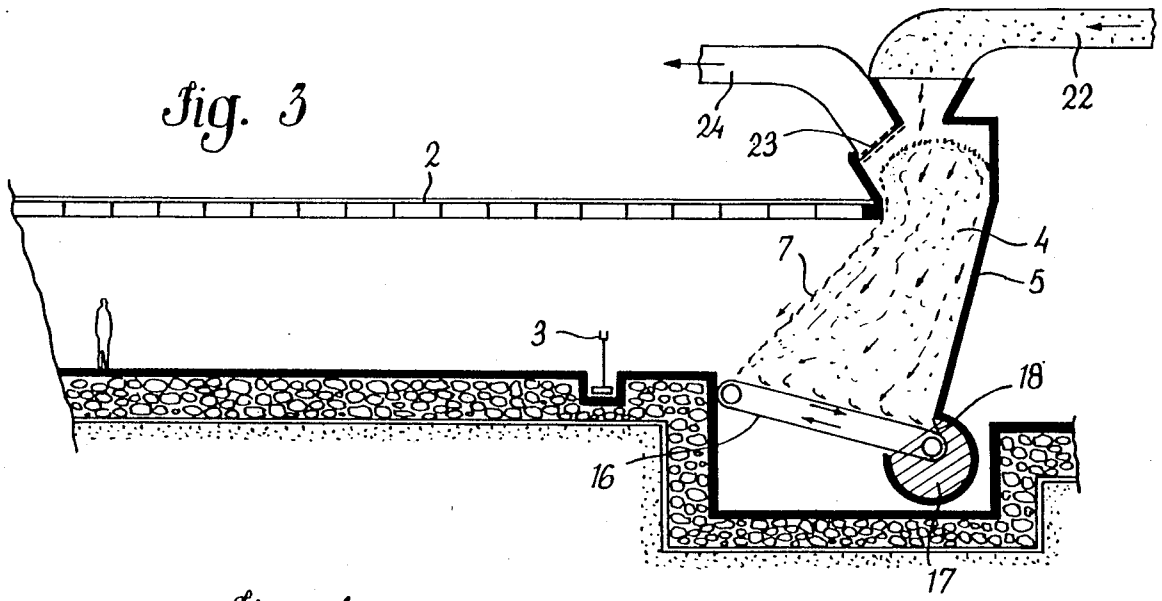
FIG. 3 shows a longitudinal vertical cross-section of a second embodiment of the projectile-arrester according to the invention.
Figure 6:
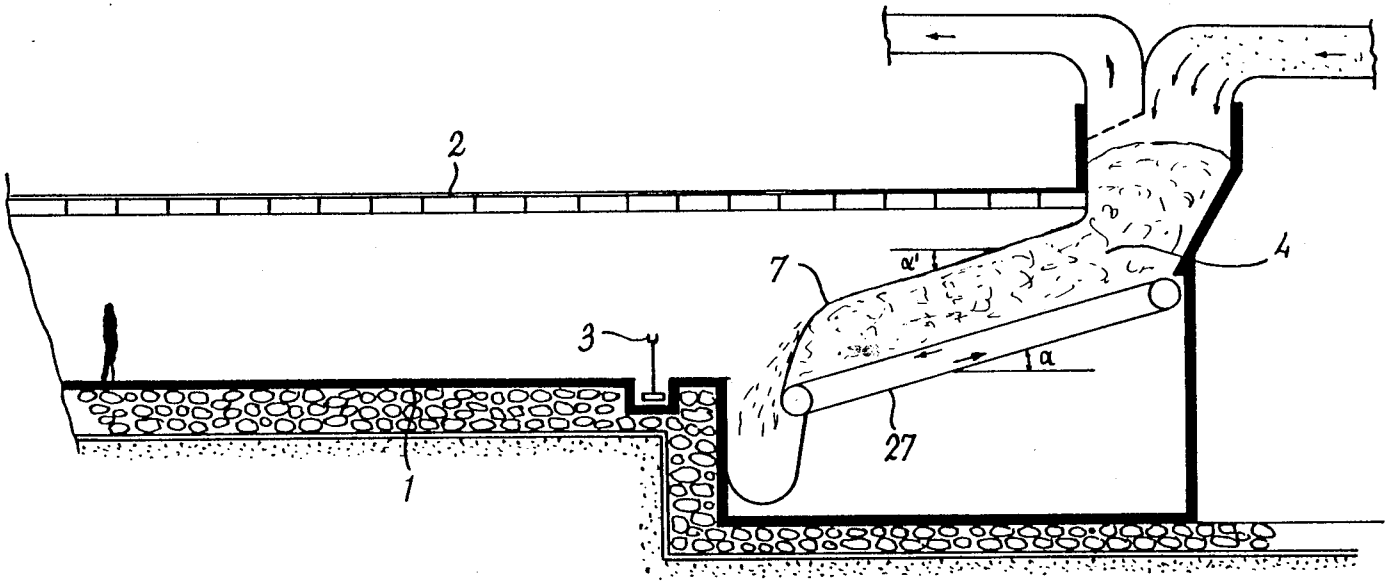
FIG. 6 shows a longitudinal vertical cross-sectional view of a third embodiment of the projectile-arrester according to the present invention.

FIGS. 1, 3 and 6 show the floor 1 and the ceiling 2 that covers the shooting-gallery and the target 3.

Figure 2:
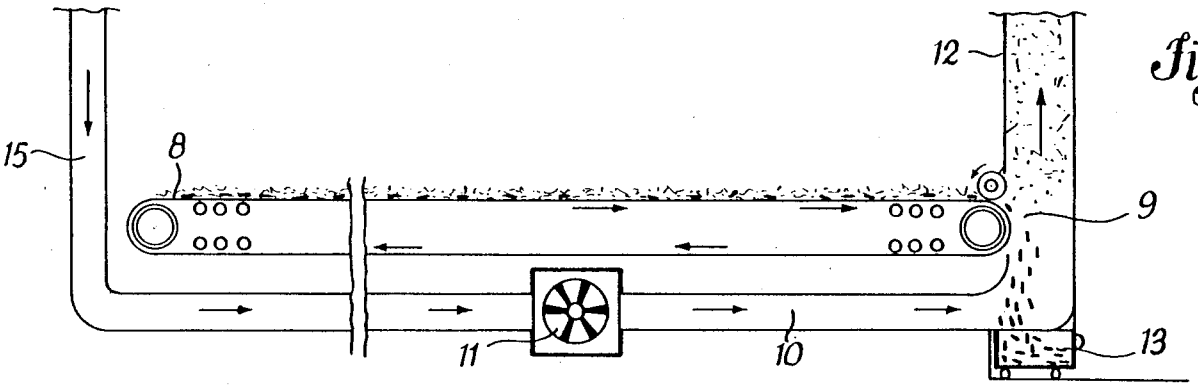
FIG. 2 is a transverse cross-sectional view of FIG. 1.

With reference now to FIGS. 1 and 2, it is to be noted that number 4 indicates the heap of granular material making up the impact structure and limited on the rear side by the wall 5. Said heap 4 rests in its lower part on a supporting gate 6 for the conveyance of the granular material, said gate sliding so as to move said granular material in the direction pointed out by the arrows, i.e. in the direction opposite to that from which the projectiles are coming.

The projectile, once fired, reaches the target 3 in about 1/10 sec., then it reaches the surface 7 of the deceleration mass consisting of the granular material in which it loses its kinetic energy by friction with the granules, so as to be decelerated till it stops at a distance from the exposed surface 7 that excludes the possibility of any rebound.

On the ground of tests carried out by the Applicant said safety is warranted also in case a volley is fired at the projectile-arrester, with any type of fire-arm officially approved for firing grounds, even from a distance of 2–3 m.

Such feature is assured by the fact that the heap of the stoppping material, as soon as the projectile passes through it, closes by effect of gravity before the other projectiles arrive, even in case of volleys.

When the firing tests are started, all the regeneration system components are activated and are kept operating by means of the mere operation of a push-button (not shown).

Number 7 indicates the surface of the heap 4 of the granular material which surface is subjected to the fires.

The granular material, together with the projectiles fired into the same is caused to drop from said sliding gate 6 onto the conveyor belt 8 that conveys said granular material as well as said projectiles towards a separation zone 9.

A blower 11 is provided upstream said zone and connected to the same through conduit 10, said blower cuasing the separation of the granular material from the projectiles by the action of the air delivered into said zone 9 through conduit 10.

The granular material is delivered through conduit 12 above the heap 4 while the projectiles will drop by gravity into the collector 13.

The air flow acting as a carrier for the granular material through conduit 12 is filtered in a suitable way, if necessary, at point 14 and then sent again through conduit 15 to the blower 11, so that a closed cycle is realized that needs no restoring of the air.

Figure 4:
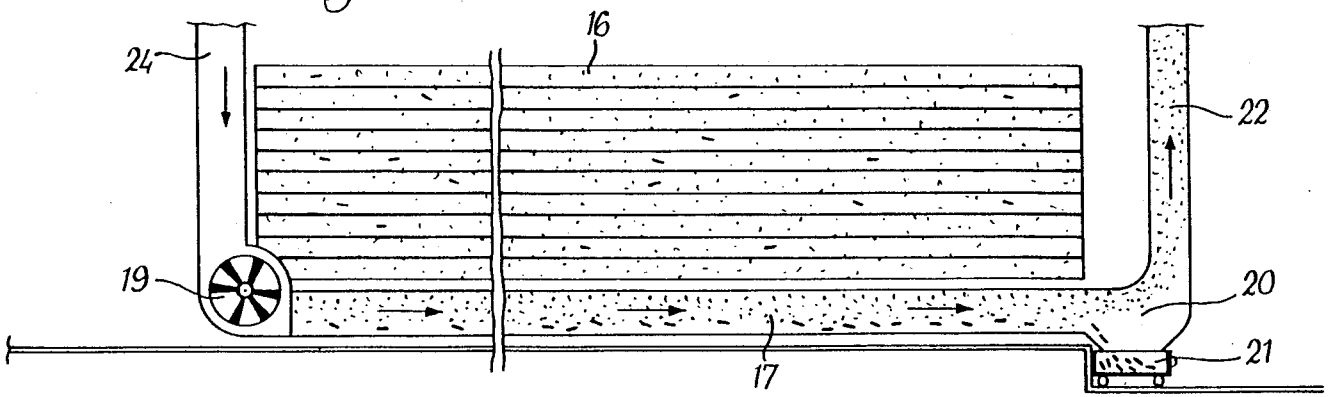
FIG. 4 is a transverse cross-sectional view of FIG. 3.
Figure 5:
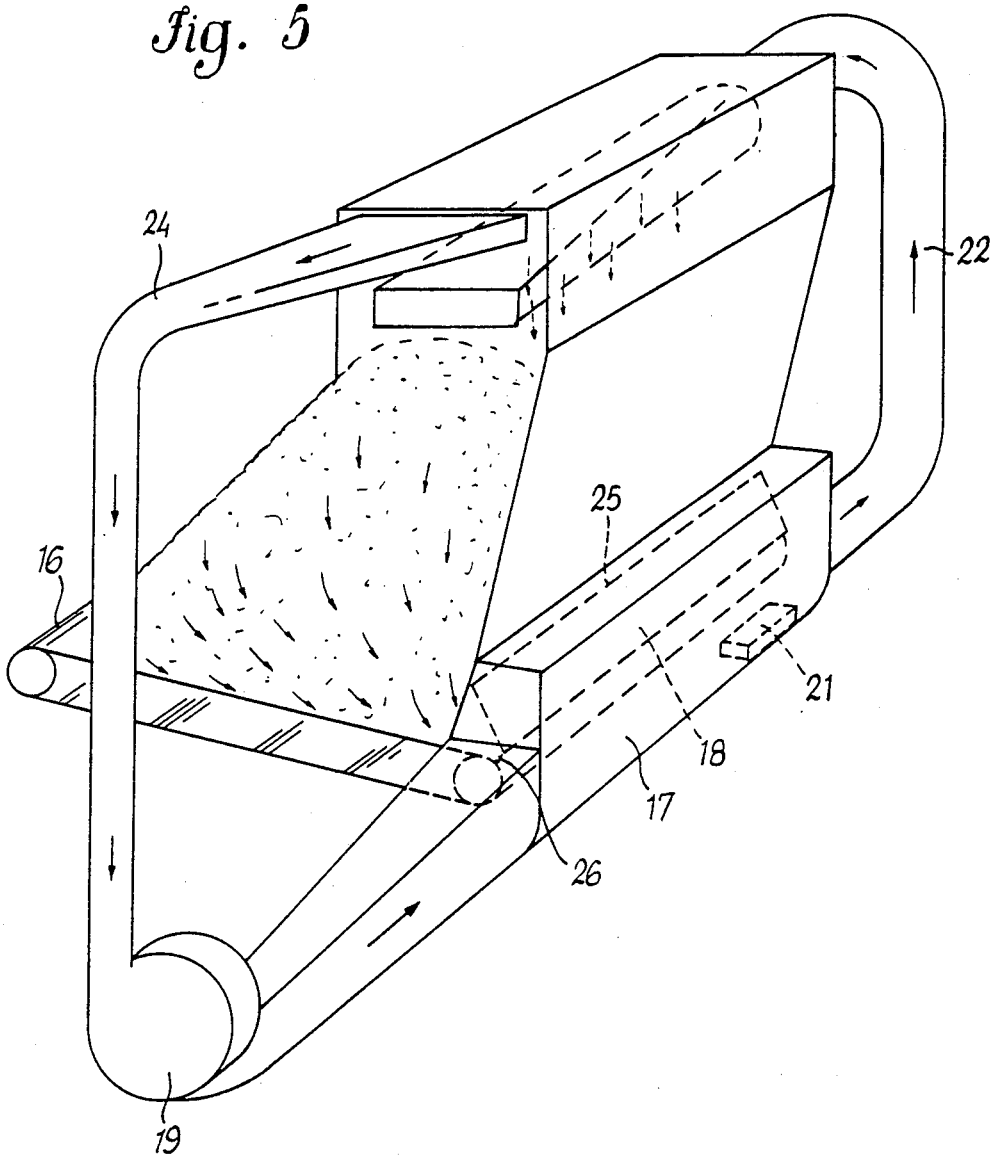
FIG. 5 is a perspective schematic view of the regeneration system of the projectile-arrester of FIG. 3.

With reference now to FIGS. 3, 4 and 5, it can be observed that the granular material in the form of the heap 4 rests on a sliding gate 16 that slides in a direction concordant with the direction the projectiles are coming from.

Said gate 16 causes the granular material and projectiles fired to drop into the conduit 17. Such drop is regulated by a metering flapper 18 provided immediately downstream said gate 16. A blower 19 is provided upstream said conduit 17, the blower acting so as to push the mixed mass of the granular material and the projectiles fired up to the zone 20 where the projectiles are collected by gravity into the box 21 whereas the granular material is pushed by the air flow through conduit 22 up to the top of the heap 4.

In that case also, the air is filtered at 23 once it has been separated from the granular material, and then it is sent again to blower 19 through conduit 24.

In FIG. 5 the hinge of the flapper 18 is pointed out by number 25, whereas number 26 points out the granules passage section.

In the embodiment shown in FIG. 6, the heap 4 of the granular material rests on a supporting and conveyor belt 27 which slopes at an angle $\alpha$ which is equal or about equal to the angle of slide $\alpha'$ of the material forming the heap 4.

Said conveyor belt 27 moves in a direction opposite to the direction the projectiles are coming from. Thus a motion is realized of the heap 4 consisting of the mixture of granular material and projectiles fired, with no slide motion inside the mass itself.

The restoration and reutilizaton system of the granules is all the same as that disclosed in the embodiments shown in FIGS. 1-5.

Figure 9:
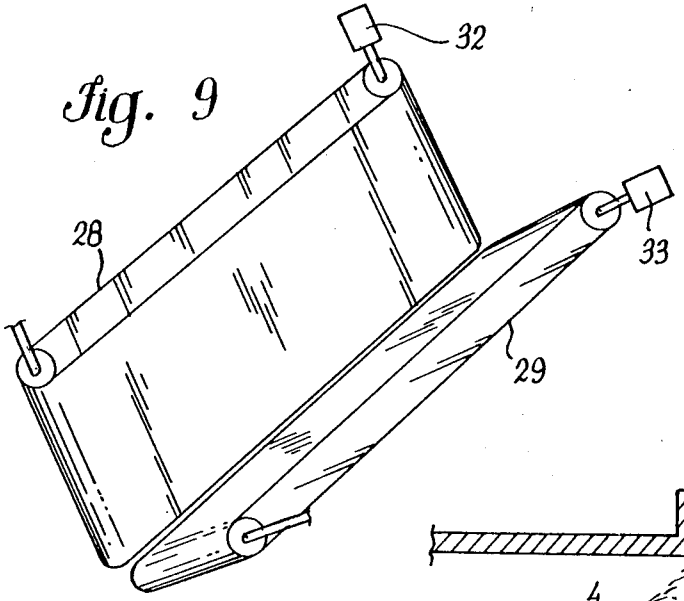
FIG. 9 is a perspective view of the group of FIG. 8.
Figure 8:
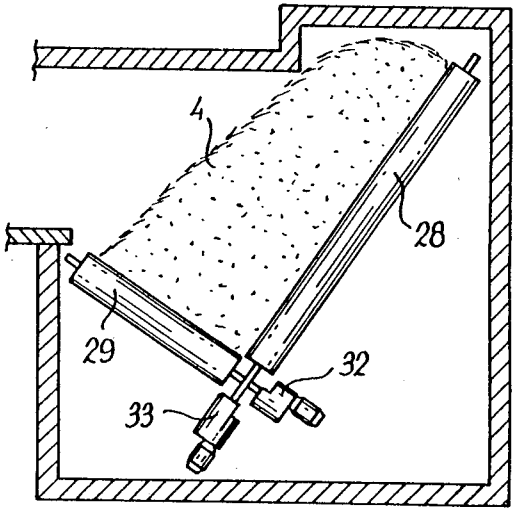
FIG. 8 is a longitudinal vertical cross-sectional view of the movement group of the impact surface of the projectile-arrester of FIG. 7.
Figure 7:
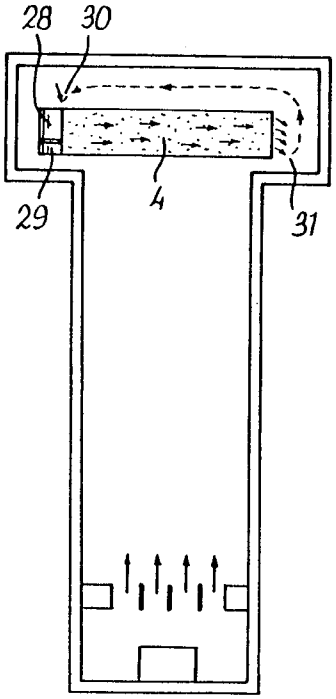
FIG. 7 is a plan schematic view of a fourth embodiment of the projectile-arrester according to the present invention.

Another embodiment of the ballistic projectile-arrester according to the present invention is that illustrated in FIGS. 7,8 and 9, in which two conveyor belts 28 and 29 are employed for the supporting and conveyor system, such belts being capable of keeping the mass according to its angle of slide and being in motion in the horizontal direction, i.e. at right angles to the principal axis of the firing ground, whereas for the regeneration and the reutilization system the solutions preferably adopted are those suggested in the embodiments previously illustrated and disclosed.

In this instance, the loading and unloading of the granular material is performed laterally with respect to the heap 4, i.e. respectively at points 30 and 31 of FIG. 7, unlike the preceding cases wherein the loading operation was performed from the top and the unloading was carried out from the bottom, or vice-versa.

Numbers 32 and 33 point out the reduction units for the motion respectively of belts 28 and 29. It is clear that, instead of the belts 28 and 29, two metallic sliding gates can be provided.

Figure 10:
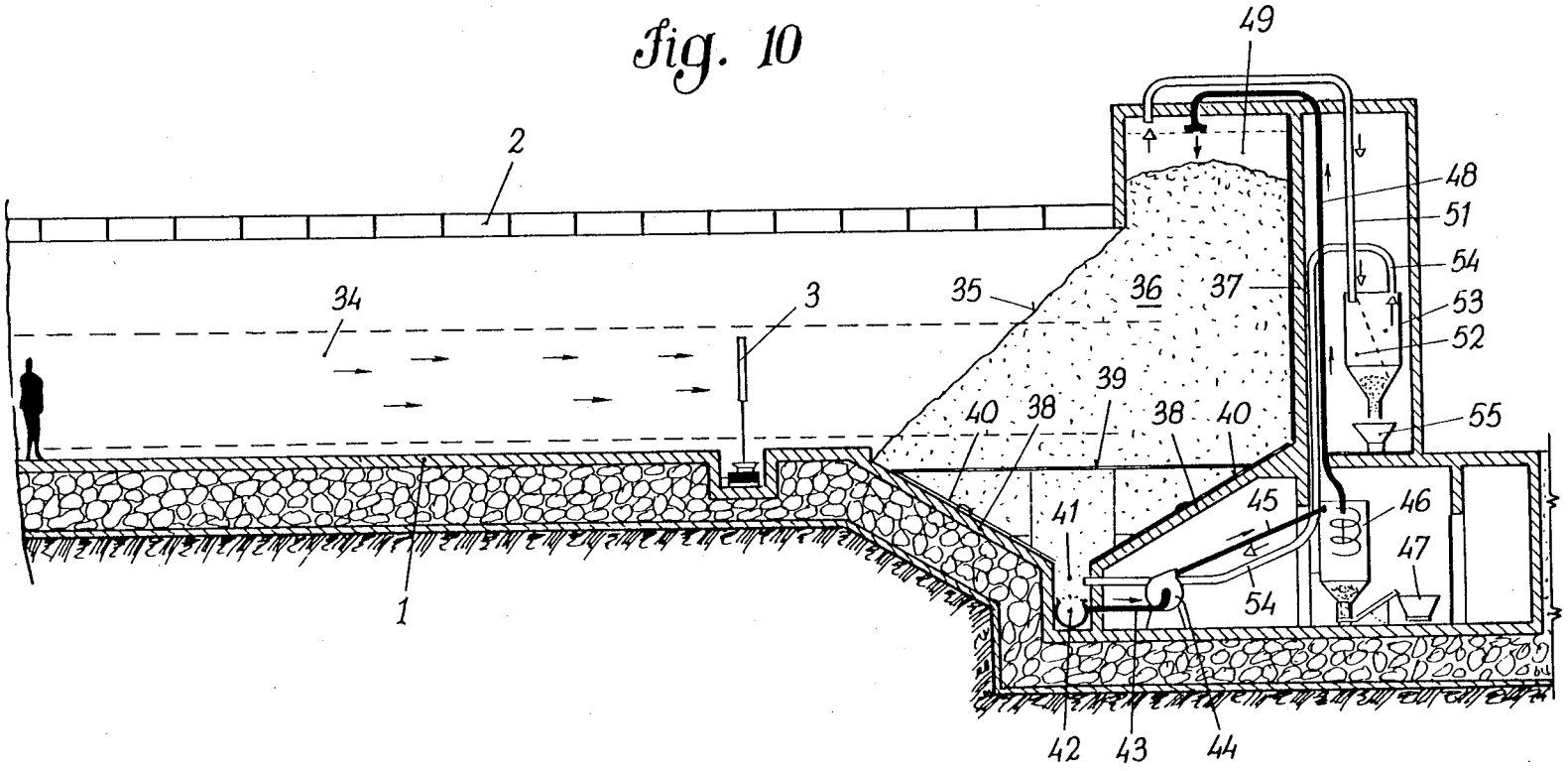
FIG. 10 shows a longitudinal vertical cross-section of a fifth embodiment of the projectile-arrester according to the present invention.

In FIG. 10 the floor 1 and the covering ceiling 2 can be observed both being realized with high strength reinforced concrete and lined with anti-wear steel, which make-up, together with the side walls, the shooting-gallery.

The target for the firing practice is pointed out by 3, whereas the zone 34 enclosed within dotted lines pointed out the zone where the 90% of the projectiles trajectories is reasonably likely to occur.

The heap 36 of the slowing down material is kept on its rear side by a ballistic steel plate 37, whereas it is collected and supported on the bottom side by the sloping walls 38 which are lined with steel plates and on which the electrical vibrating means 40 are applied.

A safety grate 39 made up of ballistic steel is provided at a position above said walls 38.

Figure 11:
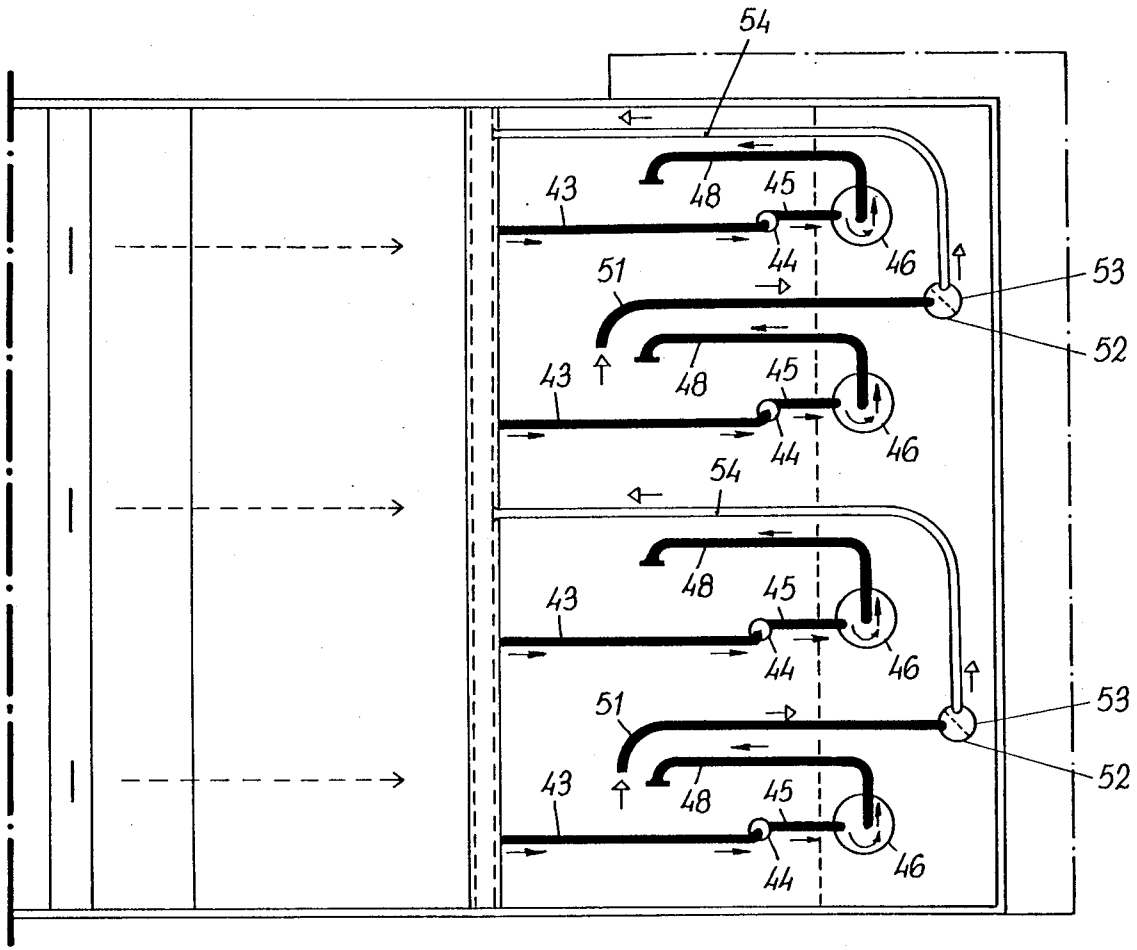
FIG. 11 shows the functional schematic arrangement of the regeneration system units of the projectile-arrester according to FIG. 10.

A passage 41 is shown at the bottom of the channel formed by said walls 38, which passage runs in the transverse direction with respect to the shooting-gallery (see also FIG. 11), the take-up openings 42 being arranged along said passage; four such openings are provided in FIG. 11, which are connected, through a pipe 43, to a delivery pump 44.

A pipe 45 departs from said pump 44, said pipe serving the purpose of conveying the granular material mixed with the projectiles into the separator 46 that collects such projectiles which, in their turn, are next taken out by means of a carriage 47.

The conduit 48 departs from the separating unit 46, such conduit conveying the granular material into the feeding chamber 49. A prefilter 50 intercepts the granules possibly present as suspended matter because of the turbulence, allowing the dusts only to pass that are carried by the conveying fluid.

Conduit 51 takes the conveying fluid and the fines to a filter 52, said dusts being settled onto the bottom of the same. The filtered air passes from chamber 53 to the pipe 54 through which it reaches the passage 41. The air is taken up again, saturated with granules, at that point through the suitable openings 52 and then put again the circulation.

It is evident from the schematic arrangement shown above that the whole ballistic projectile-arrester, with its materials and the conveying fluid for the granules, does not interact with the environment within the firing ground, and it does not give rise to polluting wastes into the environment within said firing ground.

Number 55 points out the collection carriage for the powders of the granular material.

Figure 12:
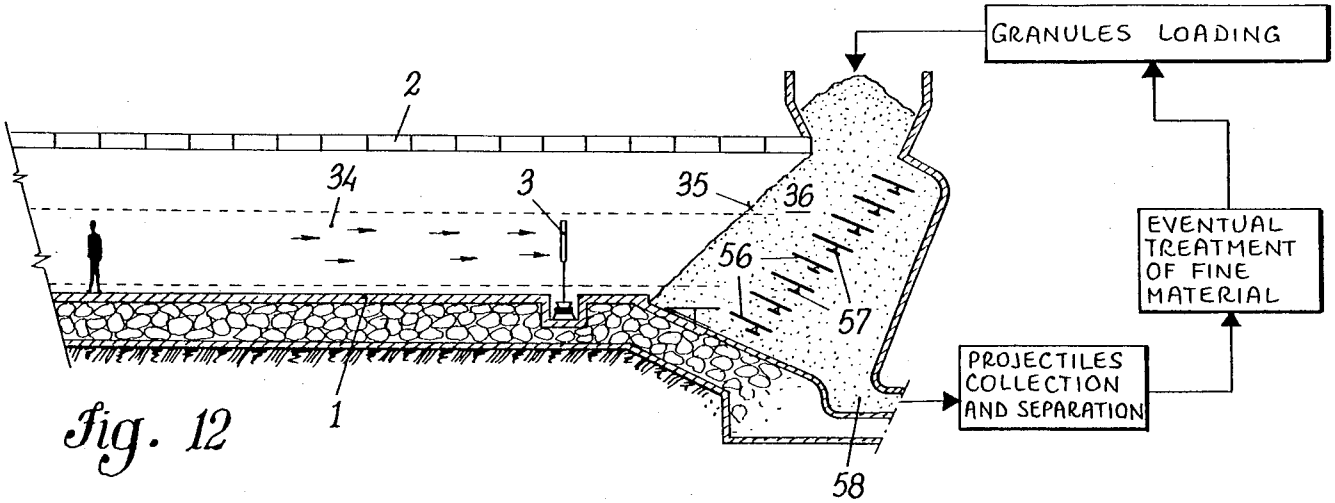
FIG. 12 shows a sixth embodiment of the projectile-arrester according to the present invention.

In FIG. 12, the steel plates 56 are shown, sloping almost at right angles with respect to the line of slope of the exposed surface 35, which plates are provided within the heap 36 of granular material with the vibrating means 57 coupled to them. The granular material, together with the projectiles contained in it, is conveyed through the motion of said plates 56 and vibrating means 57 towards the passage 58, from which both the granular material and the projectiles are taken up to be separated, and afterwards the material is put into the circulation again according to an arrangement similar to that disclosed previously.

Figure 13:
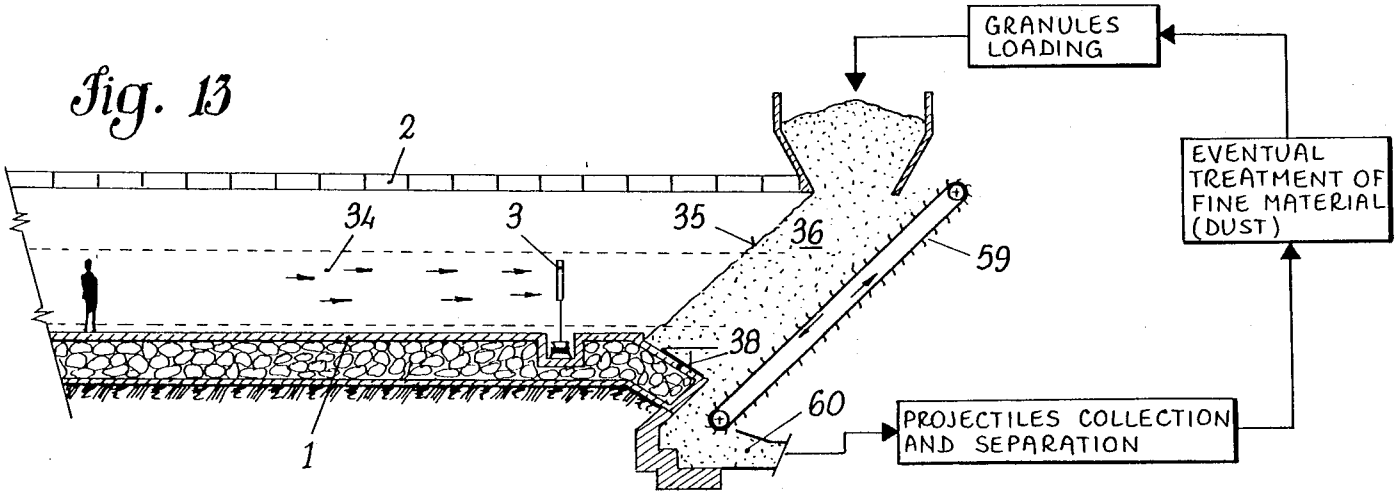
FIG. 13 shows a seventh embodiment of the projectile-arrester according to the present invention.
Figure 15:
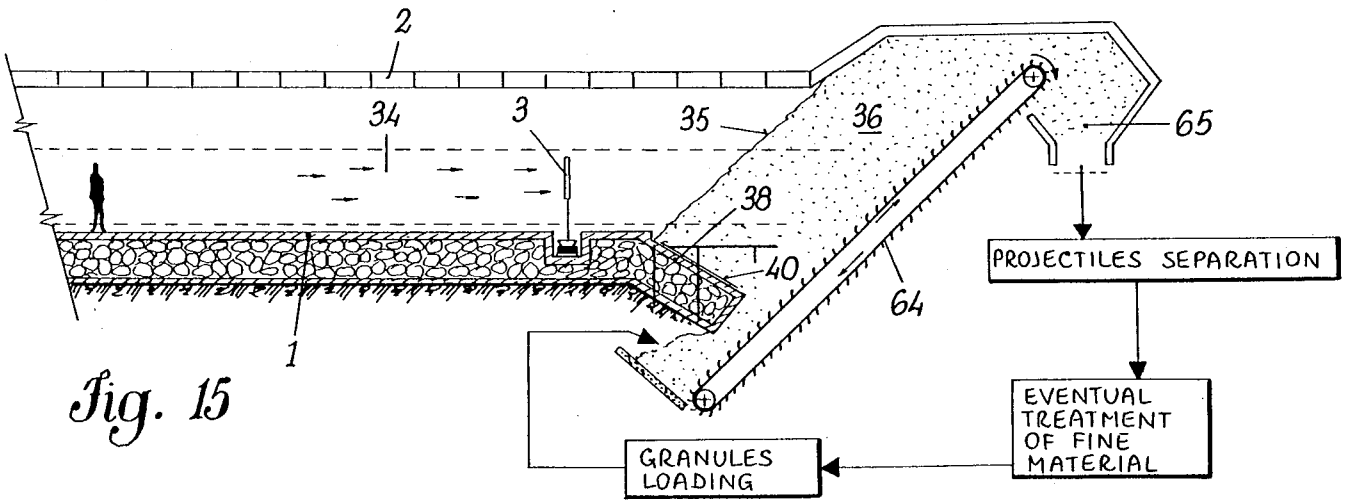
FIG. 15 shows a nineth embodiment of the projectile-arrester according to the present invention.

FIG. 13 illustrates the vibrating and conveyor system realized through a conveyor belt 59 that conveys both the granular material and the projectiles towards a passage 60 provided in the lower part, whereas FIG. 15 shows the situation in which the conveyor belt 64 conveys both the granular material and the projectiles towards a passage 65 provided in the upper part, the make-up material being introduced below the heap 36 of material, unlike the preceding case.

Figure 14:
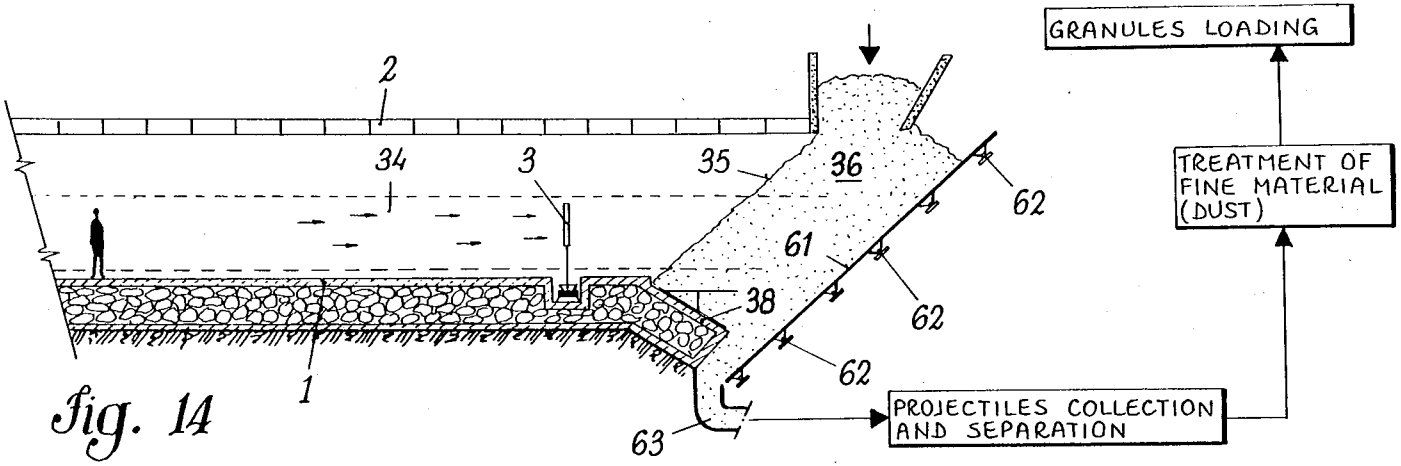
FIG. 14 shows an eighth embodiment of the projectile-arrester according to the present invention.

FIG. 14 illustrates finally a further vibrating system which provides a steel plate 61, in an almost parallel position with respect to the exposed surface 35 of the heap 36, the vibrating means 62 being provided below said plate for conveying the granular material towards the passage 63.

The results of some firing tests carried out by the Applicant are reported for illustrative purposes:

TEST I

Material to be tested: 20 mm foam rubber in the form of bags of heavy polyethylene Arm: lightweight automatic rifle "F.A.L.", 7.62 rauge NATO, with SMI 9.30 g projectile Firing distance: 40 m Direction of the projectiles: at right angles to the material to be tested Position of the shooter: on the ground in yard Results: the first 5–6 projectiles were stopped after going through a thickness of about 1.30–1.50 m of the material with no appreciable deformation.

TEST II

Such test was performed with the same material, the same arm, the same direction of the projectiles and the same position of the shooter, from a distance of 15 m.

Results: the results obtained were similar to those obtained in TEST I, the only difference being an average penetration higher of about 10–20 cm.

TEST III

This test was performed with the same material, the same arm, the same direction of the projectiles as well as the same position of the shooter as in the preceding tests, but the firing distance was 10 m and two tracer projectiles were also employed.

Results: no measurable higher penetration occurred, and no appreciable consequences were observed as a result of the retention of the two tracer projectiles within the material.

The present invention has been disclosed according to some specific embodiments of the same, but it is to be understood that modifications and changes can be introduced into the same by those skilled in the art without departing from the scope of the invention.

I claim:

1. A ballistic projectile arrester, comprising:

granular material for absorbing the kinetric energy of projectiles;

supporting means for supporting a quantity of said granular material and said supporting means including at least one supporting surface in a sloped relationship with a horizontal plane defined as being essentially parallel to the path of the projectiles;

first driving means for placing said supporting means in motion such that the motion of said supporting means results in the movement of the quantity of granular material supported by said supporting means in a specific direction;

receiving means for receiving a mixture of granular material and projectiles departing from said supporting means;

second driving means for transporting the mixture received by said receiving means to a separation zone;

separating means found within the separation zone and providing the means for separating the components of the mixture of granular material and projectiles;

delivery means for delivering the granular material separated from the mixture back to the supporting means and thereby acting to replenish the granular material lost to the receiving means; and collecting means for collecting the projectiles separated from the mixture.

2. A projectile arrester as in claim 1 wherein the at least one supporting surface of said supporting means moves in a direction generally opposite to that in which the projectiles travel.

3. A projectile arrester as in claim 1 wherein the at least one supporting surface of said supporting means moves in a direction which is generally the same as that in which the projectiles travel.

4. A projectile arrester as in claim 1 wherein said supporting means includes two conveyor belts each having a supporting surface travelling in a direction horizontally transverse to the path in which the projectiles travel.

5. A projectile arrester as in claim 4 wherein said conveyor belts are arranged in an angular relationship with one another such that the angle of slide of said supported quantity of granular material is kept essentially constant and there is virtually no overflow of the granular material about the sides of said conveyor belts which are furthest from the vertex of the angle formed by said conveyor belts.

6. A projectile arrester as in claim 1 wherein said supporting means includes a conveyor belt positioned essentially parallel with the exposed surface of the supported granular material and said conveyor belt rotating in a direction which acts to move the granular material downwardly.

7. A projectile arrester as in claim 1 wherein said supporting means includes both a conveyor belt and a vibration plate and said conveyor belt is positioned essentially parallel to the exposed surface of the supported quantity of granular material, and said conveyor belt rotates in a direction which acts to move the supported quantity of material upwardly and said delivery means delivers the separated granular material below the supported quantity of granular material.

8. A projectile arrester as in claim 1 wherein said supporting means includes a plurality of vibrating plates whose supporting surfaces are essentially at right angles to the exposed surface of the supported quantity of granular material.

9. A projectile arrester as in claim 1 wherein, said supporting means includes two vibrating plates in an angular relationship with one another, with the supporting surfaces of said plates converging into said receiving means positioned below said supporting means 10. A projectile arrester as in claim 1 wherein said supporting means includes a single conveyor belt having a slop essentially equal to the slide angle of the supported quantity of granular material and said conveyor belt rotating in a direction which acts to move the supported quantity of granular material downward.

11. A projectile arrester as in claim 1 wherein said granular material is fireproof.

12. A projectile arrester as in claim 1 wherein said granular material is a material selected from the group consisting of waster, chips of foamed or unfoamed plastic materials, foam rubber, foodstuffs,grains, cork, wood-shavings, chips or powder material from pneumatic tires, cork wastes, feathers, wood powders, dried grasses, expanded minerals or artificial powders.

13. A projectile arrester as in claim 1 wherein said first driving means includes means for regulating the degree of movement imposed on said supporting means and said second driving means includes regulating means for varying the amount of mixture being transported from said receiving means to the separation zone, said regulating means on said first and second driving means acting in conjucture with one another so as to insure an uninterrupted flow of granular material.

14. A projectile arrester as in claim 1 wherein said delivery means includes a conduit and a fluid driving means whereby the separated granular material is mixed with the fluid being driven in said conduit by said fluid driving means and forced away from the separation zone and towards the supporting means.

15. A projectile arrester as in claim 1 wherein said collecting means includes a melting crucible and a plurality of ingot molds whereby the projectiles separated from the mixture are melted down in said crucible and the melted material flows into said ingot molds for solidification.

16. A ballistic projectile arrester, comprising:

granular material for absorbing the kinetic energy of projectiles;

supporting means for supporting a quantity of said granular material;

first driving means for placing said supporting means in motion such that the motion of said supporting means results in the movement of the quantity of granular material supported by said supporting means in a specific direction;

receiving means for receiving a mixture of granular material and projectiles departing from said supporting means;

second driving means for transporting the mixture received by said receiving means to a separation zone;

separating means for separating the components of the mixture of granular material and projectiles;

delivery means for delivering the granular material separated from the mixture back to the supporting means, said delivery means including a first conduit and a fluid driving means, whereby the separated granular material is mixed with fluid being driven in said first conduit by said fluid driving means and forced away from the separation zone and towards the supporting means; and collecting means for collecting the projectiles separated from the mixture.

17. A projectile arrester as in claim 16 wherein said receiving means is in the form of a conveyor belt and said second driving means acts to rotate said conveyor belt so as to transport the mixture on said conveyor belt to the separation zone.

18. A projectile arrester as in claim 17 wherein the separation zone is located at one end of said first conduit and the fluid being driven by said fluid driving means acts as said separating means whereby the fluid forces the lighter granular material to flow in the direction of fluid flow while allowing for the heavier projectiles to drop into said collecting means.

19. A projectile arrester as in claim 18 further comprising an expansion chamber located above said supporting means into which said first conduit extends, such that the separated granular material being delivered to said chamber drops by gravity onto the quantity of supported granular material below;

a second conduit having a first end in communication with said chamber and a second end in communication with the end of said first conduit within the separation zone so as to provide a continuous recirculation loop for the fluid.

20. A projectile arrester as in claim 19 wherein said fluid delivery means is a blower located in line with said second conduit and said fluid being circulated is air.

21. A projectile arrester as in claim 20 wherein filtering means is provided in said chamber between the ends of said first and second conduit means so as to insure that no granular material is drawn into said second conduit.

22. A projectile arrester as in claim 20 further comprising automatic self-regulation means for the air in the continuous recirculation loop.

23. A projectile arrester as in claim 16 wherein said receiving means is in the form of a slotted conduit which is in communication with one end of said first conduit means, and said second driving means is the fluid driven by said fluid driving means and said separating means is also the fluid driven by sayd fluid driving means, whereby the fluid forces the mixture within said slotted conduit to the separation zone and the differences in weight between said granular material and the projectiles results in the fluid forcing the lighter granular material upwardly further along said first conduit while the heavier projectiles, not being lifted upwardly by the fluid, drop into said collecting means.

24. A projectile arrester as in claim 23 further comprising, an expansion chamber located above said supporting means and into which said first conduit extends such that the separated granular material being delivered to said chamber drops by gravity onto the quantity of supported granular material below;

a second conduit having a first end in communication with said chamber and a second end in communication with the end of said slotted conduit which is furthest from the separation zone so as to provide a continuous recirculation loop for the fluid.

25. A projectile arrester as in claim 24 wherein said fluid delivery means is a blower located in line with said second conduit and said fluid being circulated is air.

26. A projectile arrester as in claim 25 wherein filtering means is provided in said chamber between the ends of said first and second conduit means so as to insure no granular material is drawn into said second conduit.

27. A projectile arrester as in claim 16 further comprising an expansion chamber located above said supporting means into which one end of said first conduit extends such that the separated granular material being delivered to said chamber drops by gravity onto the quantity of supported granular material below, said first fluid conduit having a second end in communication with said receiving means, said second driving means being in the form of a pump in line with said first fluid conduit and acting to draw the mixture from said receiving means to said expansion chamber.

28. A projectile arrester as is claim 27 wherein said separating means includes a separator in line with said first fluid conduit between said pump and said chamber.

29. A projectile arrester as in claim 27 further comprising a second fluid conduit having a first end extending into said expansion chamber and a second end positioned underneath the quantity of granular material supported by said supporting means so as to provide a continuous recirculation loop for the fluid, whereby the fluid passes upwardly through the supported granular material into said chamber and then back around underneath the supported granular material.

30. A projectile arrester as in claim 29 further comprising a filter means placed in line with said second fluid conduit and providing a means for the removal of dust picked up by the fluid as it passes through the recirculation loop.

31. A projectile arrester as in claim 29 wherein the fluid is air.

32. A projectile arrester as in claim 29 wherein a plurality of recirculation loops are positioned side by side along the length of said receiving means.

33. A projectile arrester as in claim 16 wherein said collecting means includes a melting crucible and a plurality of ingot molds whereby the projectiles separated from the mixture are melted down in said crucible and the melted material flows into said ingot molds for solidification.

34. A ballistic projectile arrester, comprising:

granular material for absorbing the kinetic energy of projectiles;

supporting mean for supporting a quantity of said granular material said supporting means including at least one supporting surface in a sloped relationship with a horizontal plane defined to be essentially parallel to the path of the projectiles, with the slope of said supporting surface being substantially the same as the slide angle of the quantity of granular material being supported on the supporting surface;

first driving means for setting said supporting means in motion such that the motion of said supporting means results in the movement of the quantity of granular material downwardly along the supporting surface;

receiving means for receiving a mixture of granular material and projectiles departing from said supporting means;

second driving means for transporting the mixture received by said receiving means to a separation zone;

separating means found within the separation zone and providing the means for separating the components of the mixture of granular material and projectiles;

delivery means for delivering the granular material separated from the mixture back to the supporting means and thereby acting to replenish the granular material lost to the receiving means and;

collecting means for collecting the projectiles separated from the mixture.

* * * * *